United States Patent [19]

Coulter

[11] Patent Number: 5,074,421

[45] Date of Patent: Dec. 24, 1991

[54] QUARTZ TUBE STORAGE DEVICE

[75] Inventor: David W. Coulter, Austin, Tex.

[73] Assignee: Sematech, Inc., Austin, Tex.

[21] Appl. No.: 557,259

[22] Filed: Jul. 24, 1990

[51] Int. Cl.[5] ..... A47G 29/00

[52] U.S. Cl. ..... 211/78; 211/163; 211/166

[58] Field of Search ..... 211/78, 70, 163, 77, 211/166

[56] References Cited

U.S. PATENT DOCUMENTS

| | | | |
|---|---|---|---|
| 421,352 | 2/1890 | De Weese et al. | 211/70 X |
| 494,704 | 4/1893 | Hansen | 211/78 |
| 663,046 | 12/1900 | Schaeffer | 211/78 X |
| 1,586,826 | 6/1926 | Michelbach | 211/70 |
| 1,586,827 | 6/1926 | Michelbach | 211/70 |
| 4,026,220 | 5/1977 | Schuring, Jr. | 211/78 X |
| 4,899,968 | 2/1990 | Eaglin et al. | 211/78 X |

*Primary Examiner*—Reinaldo P. Machado
*Assistant Examiner*—Sarah A. Lechok
*Attorney, Agent, or Firm*—William W. Kidd

[57] ABSTRACT

A quartz tube carousel device for vertically storing quartz tubes used in semiconductor fabrication. The carousel stores the quartz tubes in an upright position to conserve floor space and, further, provides for 360 degree rotation for ease of access. Laminar air flow is provided through openings in the device for purging the tubes. Optional features allow for different size, shape and number of tubes to be stored, as well as forced gas purging of the quartz tubes.

15 Claims, 4 Drawing Sheets

Fig. 8
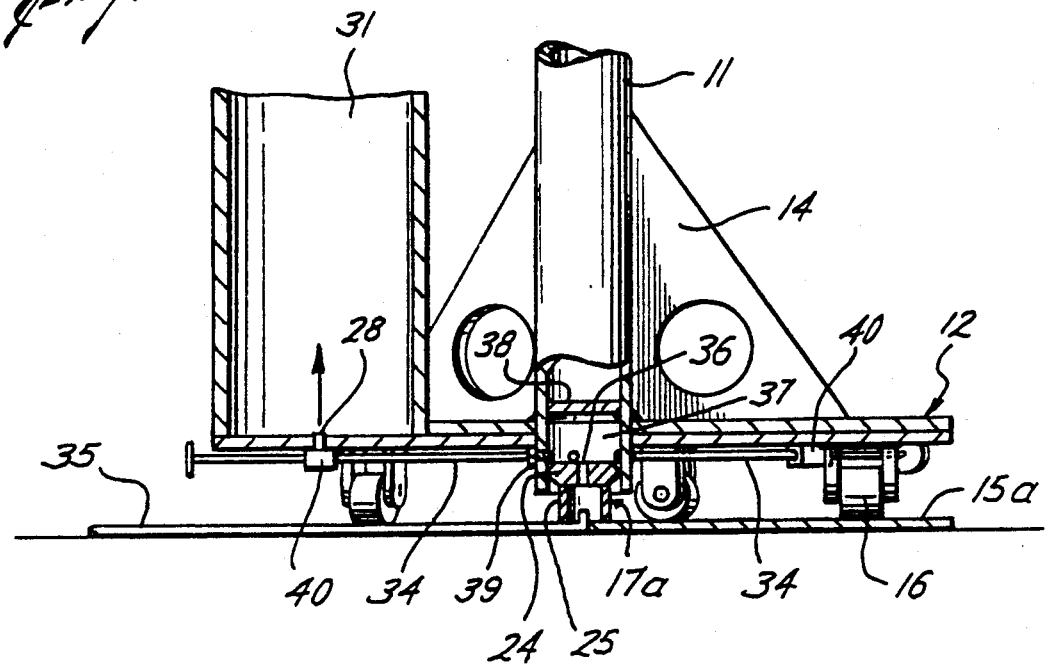
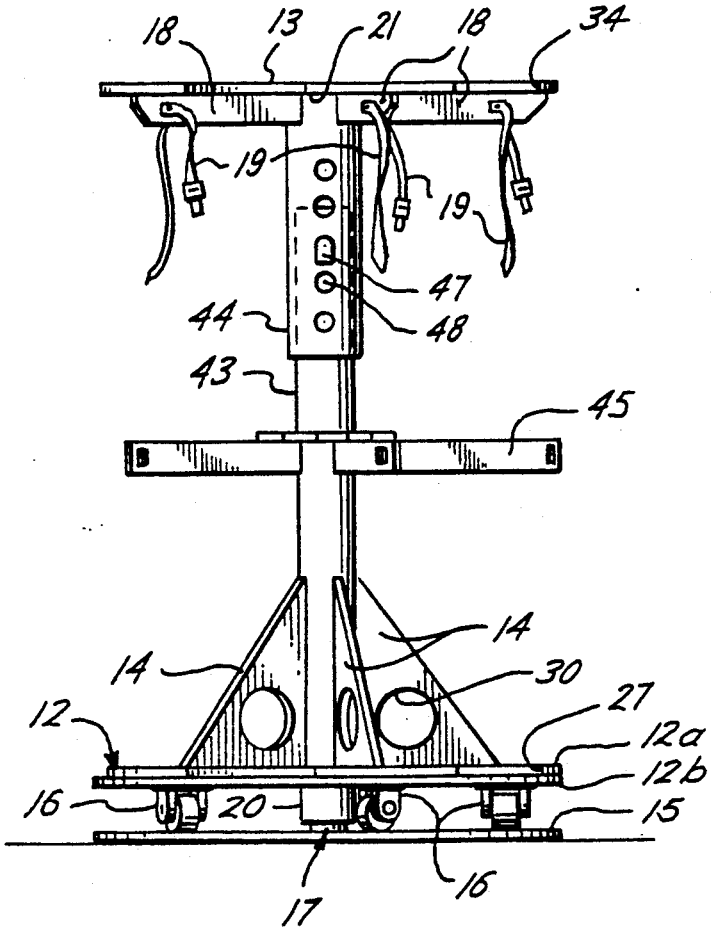
Fig. 9

QUARTZ TUBE STORAGE DEVICE

BACKGROUND OF THE INVENTION

1. Field of the Invention

The present invention relates to the field of manufacturing storage devices and, more particularly, to quartz tube storage devices.

2. Prior Art

In the manufacture of silicon based semiconductor integrated circuit devices, various circuit elements are formed in or on a base silicon substrate. Generally, the process of forming these various circuit elements starts from a base silicon wafer, which is typically flat and is circular in shape. On each of these flat circular wafers a number of integrated circuit devices, typically known as "chips" are formed by the use of various well-known techniques, including photolithography, doping, depositing, etching, and annealing techniques, just to name a few.

The silicon wafers are typically formed, stored and processed in elongated glass-type containers commonly referred to as quartz ware or quartz tubes. These quartz containers are utilized primarily due to the high temperatures encountered in the furnaces for processing silicon wafers and the ability of these containers to withstand such high temperatures.

These tubes are typically stored horizontally in racks or in PVC pipes, or they are stored vertically, side-by-side, in cabinets or in racks. However, such storage schemes currently in practice require considerable floor space or present difficulty in handling the containers. For example, horizontal storage requires floor space at least as long as the containers themselves. If PVC piping is used for storage, additional floor space is required to allow the tubes to be pulled out of the PVC piping. If vertical storage is used, any stacking will present a problem in accessing a given tube.

As an additional example, six typical quartz tubes 13 inches in diameter and 9 feet long, would if stored horizontally, take floor space approximately 30 in. × 18 ft. Storing tubes vertically side-by-side in a cabinet or a rack will use approximately 18 in. deep × 7 ft. long. Where ample space is available for storage of these tubes, floor space consideration is not a concern. However, in the highly controlled clean room environment of semiconductor fabrication, floor space usage is always a paramount concern.

It is appreciated then that a need exists for a device to store quartz tubes in an easily accessible manner and reduce the floor space requirement for such storage.

SUMMARY OF THE INVENTION

A quartz tube carousel for storing quartz tubes utilized in semiconductor processing is described. The carousel is comprised of a base plate and a top plate supported on an elongated stanchion tube. The lower end of the stanchion passes through a central opening in the base plate and resides on a pivoting mechanism located on a floor plate. Casters on the bottom surface of the base plate roll on the floor plate allowing for the upper part of the carousel to rotate in relation to the floor plate.

Quartz tubes are stored vertically on the base plate and are held in cut-outs present within the top plate by straps. Openings placed in the base plate allow for the air to pass through the tube in order to keep the interior of the quartz tube clean.

In an alternative embodiment, gas passages are provided to feed nitrogen to the openings in the base plate in order to use forced gas to purge the quartz tubes. In another embodiment, inserts are used to accommodate different shaped and sizes of tubes. Other features, such as telescoping stanchions, use of handles, storage of related tools, provide available options with the carousel of the present invention.

The use of a carousel of the present invention to store quartz tubes requires less floor space over prior art schemes and at the same time to allow for ease of handling the quartz tubes.

BRIEF DESCRIPTION OF THE DRAWINGS

FIG. 8 is a pictorial view of a gas feed system used with the floor and base plates of an alternative embodiment of the present invention.

FIG. 9 is a pictorial view of an alternative embodiment showing provisions for a telescoping stanchion and handles for rotation.

DETAILED DESCRIPTION OF THE INVENTION

A carousel device for vertically storing quartz tubes is described. In the following description, numerous specific details are set forth, such as specific shapes, sizes and materials, etc., in order to provide a thorough understanding of the present invention. It will be obvious, however, to one skilled in the art that the present invention may be practiced without these specific details. In other instances, well-known techniques have not been described in detail in order not to unnecessarily obscure the present invention.

Figure 1:
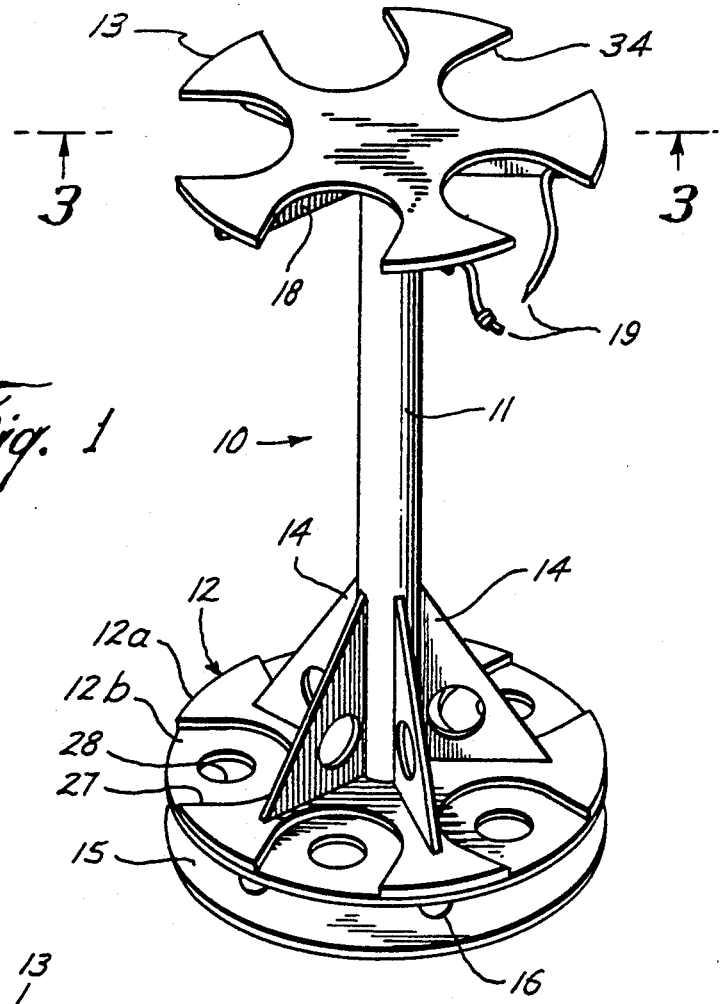
FIG. 1 is a pictorial view of a quartz tube carousel of the present invention.
Figure 3:
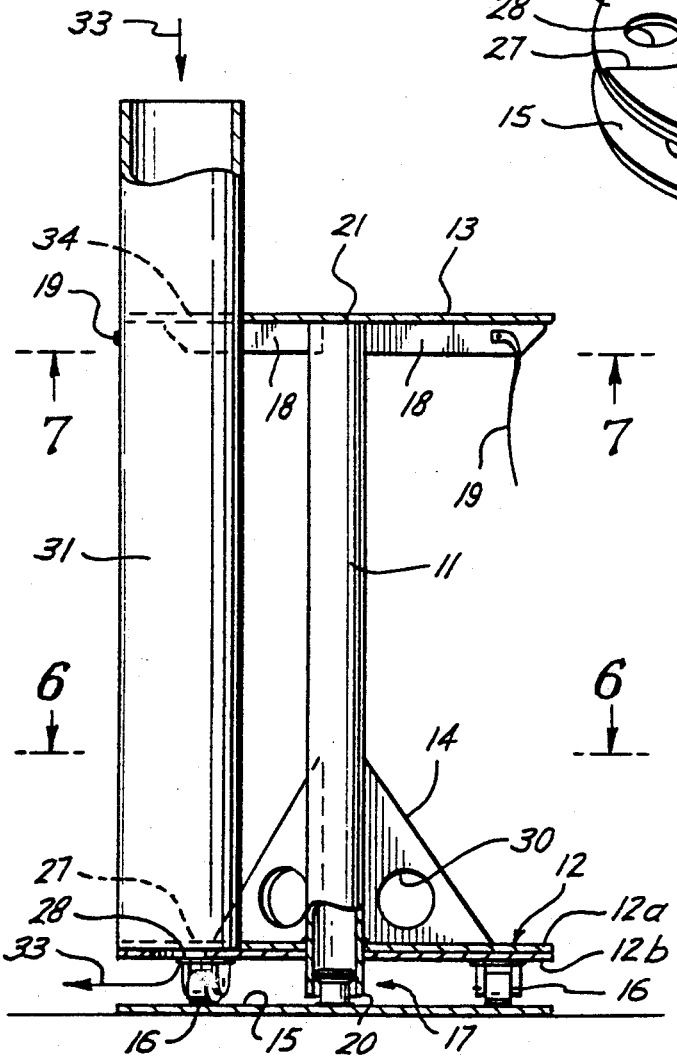
FIG. 3 is an elevation view of the carousel of FIG. 1.
Figure 2:
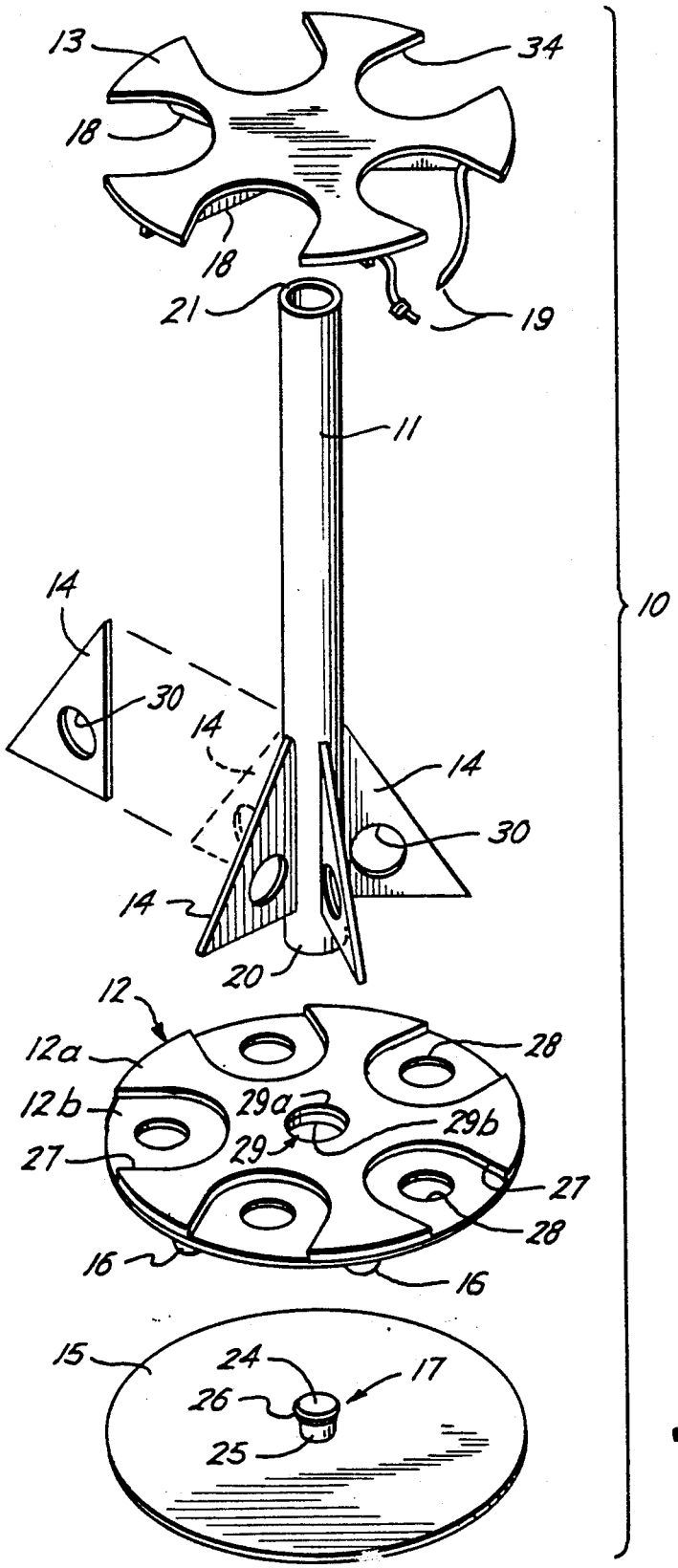
FIG. 2 is an exploded view of the carousel of FIG. 1.

Referring to FIGS. 1, 2 and 3, a quartz tube storage device 10 of the present invention is shown. Device 10 is comprised of a vertical stanchion 11, base plate 12, top plate 13, gussets 14, floor plate 15, casters 16, pivoting mechanism 17 and upper supports 18. Floor plate 15 is substantially flat and is circular in shape. Floor plate 15 is substantially flat in order for it to reside on a flat surface, such as a floor of a manufacturing facility.

Disposed at the center of floor plate 15 is the pivoting mechanism 17. Mechanism 17 can be constructed as part of floor plate 15, such as by having it and floor plate 15 molded as a single unit, or mechanism 17 can be a separate element, which is then affixed to floor plate 15 by some well-known mounting technique, such as by the use of bolts, screws, welds, etc. In the preferred embodiment, mechanism 17 is constructed separately and welded to floor plate 15. In the preferred embodiment floor plate 15 is constructed from polypropylene and is fabricated by cutting a circular plate from flat sheet of polypropylene.

Stanchion 11 is an elongated tube having a cylindrical shape. Although the shape of the stanchion 11 is not critical to the practice of the present invention, the cylindrical shape is preferred for use with the pivoting mechanism 17 of the preferred embodiment. The stanchion 11 of the preferred embodiment is substantially hollow in order to reduce weight, but it is not essential that stanchion 11 be completely hollow. One end 20 of stanchion 11 is disposed over bottom plate 15, wherein pivoting mechanism 17 is positioned within the hollow opening of end 20. The hollow opening is also circular in shape. Although a variety of schemes can be practiced to allow stanchion to rotate about pivoting mechanism 17, therein rotating in relation to floor plate 15, the preferred embodiment uses friction fit between the inner surface of stanchion and mechanism 17. Furthermore, stanchion 11 of the preferred embodiment is obtained by cutting a section of desired length from a polypropylene tube.

Figure 4:
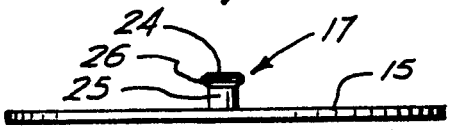
FIG. 4 is an elevation view of a floor plate and a pivoting mechanism of the preferred embodiment.

The pivoting mechanism 17 of the preferred embodiment is shown in detail in FIG. 4. Mechanism 17 is manufactured to have a ring 24 which is supported to the floor plate 15 by a support stand 25. The diameter of the ring 24 is designed to be slightly less than the internal diameter of stanchion 11, such that the interior surface of stanchion 11 friction fits onto ring 24, thereby allowing stanchion 11 to rotate about ring 24 which is stationary. In order for stanchion 11 to fit over ring 24, support stand 25 will need to have a diameter equal to or less than the diameter of ring 24. Although ring 24 and stand 25 could have the same diameter, wherein ring 24, in essence, becomes part of stand 25, the preferred embodiment maintains a minimum surface contact area between ring 24 and the interior surface of stanchion 11. As is noted in FIG. 4, ring 24 is chamfered to form a contact edge 26 to reduce the contact surface against the interior surface of stanchion 11 and, thereby, reduce the contact friction when stanchion 11 is rotated about ring 24.

In the preferred embodiment, ring 24 is cut to a predetermined diameter from a sheet of polypropylene, while stand 25 is obtained from a section of polypropylene tubing. Thus, the interior of stand 25 is hollow, although it need not be. Stand 25 is welded to the floor plate 15 and ring 24 is welded to the opposite end of stand 25. Thus, pivoting mechanism 17 is permanently affixed to floor plate 15, wherein permitting stanchion 11 to rotate about it. It is to be noted that the pivoting mechanism 17 of the preferred embodiment is simple to construct, but is effective in providing the desired function. Furthermore, although a particular pivoting mechanism 17 is described, it is to be appreciated that other pivoting mechanisms, such as bearings, can be readily adapted for use as pivoting mechanism 17.

The base plate 12 of device 10 is disposed proximate to floor plate 15. Base plate 12 is substantially flat and is circular in shape, the diameter being approximate to the diameter of the floor plate 15. Although a variety of devices can be used as spacer elements to space the base plate 12 above the floor plate 15, the preferred embodiment utilizes swivel casters 16. A plurality of casters 16 are affixed to the bottom surface of base plate 12, wherein the wheels of casters 16 reside on the upper surface of the floor plate 15. The base plate 12 has an opening 29 at its center, in order to allow stanchion 11 to pass through this opening 29.

Figure 5A:
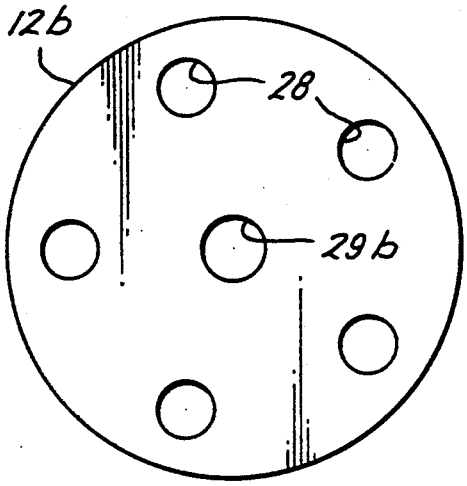
FIGS. 5A and 5B show top elevation views of two plates used to form a base plate of the preferred embodiment.
Figure 5B:
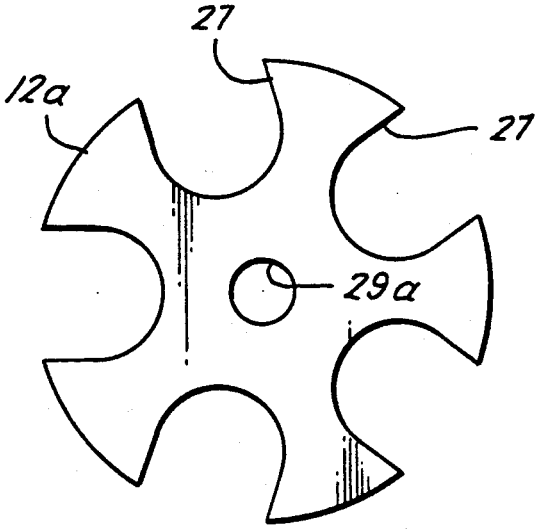

In actuality, base plate 12 of the preferred embodiment is comprised of an upper plate **12*a* and lower plate 12*b*. These two plates are further shown separately in FIGS. 5A and 5B. Lower plate 12*b* has a central opening 29*b* for the passage of stanchion 11. Other openings 28 are provided on lower plate 12*b* for permitting air passage through lower plate 12*b*. Upper plate 12*a* also has a central opening 29*a* for the passage of stanchion 11. Upper plate 12*a* is substantially circular in shape, but has cut-outs 27 which are substantially U-shaped. Cut-outs 27 are located on upper plate 12*a* so that when upper plate 12*a* is placed atop lower plate 12*b*, each opening 28 resides within a corresponding U-shaped cut-out 27, so that air passage through base plate 12 is not blocked. The size and shape of the cut-outs 27 are a design choice, as long as the lower end of a quartz tube 31 can be disposed within cutout 27 so as to rest on lower plate 12*b***.

Both upper and lower plates **12*a-b* of the preferred embodiment are cut from a sheet of polypropylene and have the same diameter measurement. Central opening 29*b* and air passage openings 28 are made in bottom plate 12*b* by cutting or boring. For the upper plate 12*a*, central opening 29*a* is cut or bored and cut-outs 27 are cut. Then upper plate 12*a* is placed atop lower plate 12*b* and the edges at the joinder are welded to form a single base plate 12. It is to be appreciated that although the preferred embodiment uses two separate plates 12*a-b* to form base plate 12, it can be readily constructed from a single plate. Furthermore, openings 28** need not be present if air passage through the quartz tubes is not desired or needed.

Stanchion 11 is affixed to base plate 12 by the use of gussets 14. After end 20 of stanchion is passed through central opening 29 it is permanently affixed to base plate 12 by gussets 14. Gussets 14 also support stanchion 11 to maintain it upright and perpendicular to base plate 12. Thus, by affixing stanchion 11 to base plate 12 and positioning it vertically, stanchion 11 and base plate 12 can be made to rotate in relation to floor plate 15. The positioning of the casters 16 toward the outer rim of base plate 12 distributes the load and provides a low friction contact for rotating base plate 12 in relation to floor plate 15. Also it is to be noted that end 20 of stanchion 11 extends a distance from the bottom surface of base plate 12 which is no more than that of the casters 16, so that end 20 can fit onto the pivoting mechanism 17 and still permit casters 16 to make rolling contact with floor plate 15.

Figure 6:
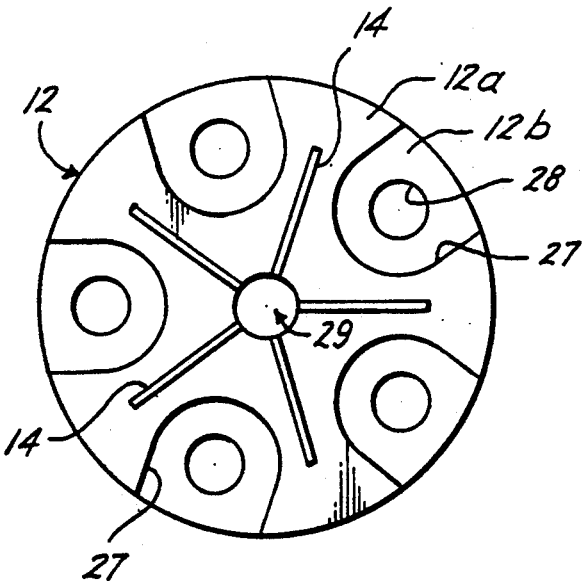
FIG. 6 a top elevation view of the base plate having gussets resident thereon.

A top elevation view of the base plate 12 with the placement of the gussets 14 is shown in FIG. 6. It is to be noted that the gussets 14 are positioned between each of the cut-out regions 27 of plate 12. During use, quartz tubes 31 (only one is shown in the drawings) are disposed above the cut-out region 27 and between the gussets 14.

The gussets 14 are permanently affixed to stanchion 11 and base plate 12 by welding. That is, welds are made at the locations where each gusset 14 makes contact with stanchion 11 and with base plate 12. The gussets 14 of the preferred embodiment are substantially triangular in shape, having a right angle proximate to the central opening 29. Further, holes 30 are provided in gussets 14 for the purpose of reducing weight, as well as for aesthetics, but without sacrificing the structural integrity of stanchion 11. However, it is to be appreciated that the shape of the gussets 14, as well as any holes, such as holes 30, are completely a design choice. Furthermore, other means can be readily adapted to provide the structural support which is provided by the gussets 14.

In the preferred embodiment, casters 16 are swivel casters with sealed bearings. The bearings are constructed from steel and polypropylene while the wheels are constructed from polypropylene. The actual number of casters 16 will depend on the desired distribution of the load and the quantity of the quartz tubes stored. The casters 16 are on swivels to permit them to roll along the angular direction of rotation of base plate 12. The casters 16 are affixed to the bottom surface of base plate 12 by the use of screws in the preferred embodiment.

Figure 7:
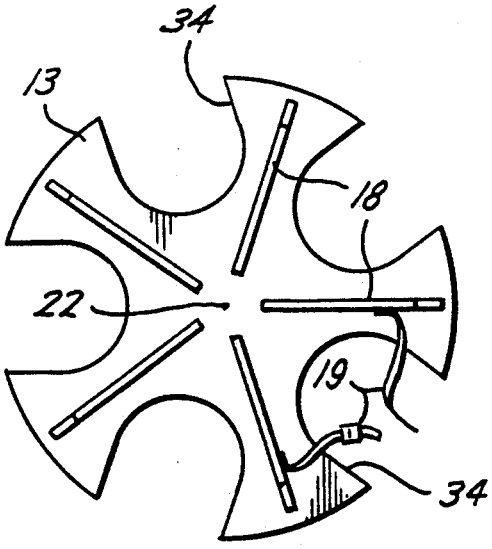
FIG. 7 is a bottom elevation view of a top plate having upper supports resident thereon.

Upper end 21 of stanchion 11 is terminated by having the top plate 13 resident thereon. As is shown in FIG. 7, top plate 13 is a substantially flat plate having a circular shape, wherein the diameter of top plate 13 is approximate to that of base plate 12. Cut-outs 34 are cut along the rim of top plate 13. The purpose of the cut-outs 34 is to permit the upper end of a quartz tube 31 to be disposed within each cut-out 34. It is to be noted that the shape and size of cut-outs 34 are a design choice, as long as the upper end of the quartz tube 31 can be disposed within cut-out 34. It is to be further appreciated that a plate equivalent to the upper plate 12*a* of FIG. 5 can be readily used for top plate 13.

Top plate 13 is centrally affixed to the upper end 21 of stanchion 11. In the preferred embodiment, top plate 13 is affixed to upper end 21 of stanchion 11 by welds at the junction. Supports 18 are then provided to support top plate 13 to be perpendicular to stanchion 11, similar to the support provided by gussets 14. Supports 18 are substantially rectangular in shape, but having beveled ends, which are proximate to the outer rim of top plate 13. A support 18 is placed between each cut-out 34. Welds are used to permanently affix supports 18 to top plate 13 and stanchion 11. Again, the shape size and number of the supports 18 are a design choice, as well as the means of affixing supports 18, as long as sufficient support is provided to the placement of the top plate 13. In actual practice, supports 18 are first affixed to top plate 13 prior to placement onto stanchion 11. This technique allows for ease of guiding top plate 13 into position on stanchion 11, due to the formation of a central area 22 at the center of top plate 13, which is shown in FIG. 7.

Then, some form of retaining means 19 is used to retain each of the quartz tubes 31 in an upright position once in place. Although various retaining means can be readily used, the preferred embodiment utilizes straps with "quick release" buckles for retaining means 19. Various well-known means for attaching straps 19 to top plate 13 can be readily used. The preferred embodiment attaches straps 19 to top plate 13 by screws and/or bolts, but other means can be readily used.

The device 10, when used, is usually disposed in a semiconductor fabrication facility and, more particularly, in a "clean room" environment. The floor plate 15 is positioned on a desired location of the clean-room floor for storing the quartz tubes. Because stanchion 11 is not permanently affixed to the floor plate 15, as well as to the attached pivoting mechanism 17, plate 15 can be readily moved to a desired location. Then the rest of the device 10 is positioned onto floor plate 15 by having stanchion 11 disposed onto mechanism 17.

Quartz tubes 31 which are to be stored are placed onto base plate 12, such that the bottom of the tubes reside within the cutouts 27 and over openings 28. The upper end of the quartz tubes 31 reside within the cutouts 34 of the top plate 13 and straps 19 are placed around the tubes to prevent the tubes from toppling. To position the tubes 31 onto device 10 or to remove the tubes 31 from device 10, an operator need not walk around the device 10 to each storage position of the device 10. Rather, the operator may stand in one location and have access to all storage positions on the device 10 simply by rotating the portion of device 10 above the casters 16. Thus, device 10 can be placed in corners of a room, other locations of limited space or locations which are difficult to access, as long as space is available to access one tube storage location on device 10. Further, because quartz tubes 31 are stored upright, less floor space is required to store a number of tubes as compared to stacking a comparable number of tubes horizontally.

Additionally, because of the placement of the tubes over openings 28 on base plate 12, laminar air flow (as shown by arrows 33) is provided through the tubes 31 to keep the interior of the quartz tubes 31 clean. Laminar air flow occurs since most modern clean rooms circulate air vertically by forcing and exhausting air through small openings in the ceiling and the floor. Thus, vertical air flow passes through the quartz tube 31 through its openings at the ends of the tube since these tubes are stored vertically in device 10.

It is to be appreciated that although a particular material is used for constructing various parts of device 10, other materials, such as PVC, can be readily adapted for use without departing from the spirit and scope of the present invention. However, it is to be stressed that the preferred embodiment uses primarily polypropylene since polypropylene is flexible and does not readily crack. Further, polypropylene is economically less expensive, easier to work with and more forgiving in usage with quartz than most other structurally usable materials. The method of welding polypropylene is well-known in the prior art, one such means being the use of hot air welders.

Furthermore, it is to be noted that inserts can be fabricated for use with the base plate 12 and/or top plate 13 to accommodate quartz tubes of different diameters. If the cutouts 27 and/or 34 are provided for the largest diameter tube being used, U-shaped inserts for holding smaller diameter tubes can be affixed to plates 12 and/or 34. These inserts can be attached by semi-permanent means, such as clips, screws, bolts, etc., so that they can be readily changed to accommodate different diameter tubes. Although a five-tube carousel is shown in FIGS. 1–7, the actual number of tubes to be stored is a design choice. By readily designing the base and top plates to have the proper number of cut-outs, a storage for a given number of tubes can be accommodated.

An alternative embodiment utilizing a pressurized gas feed system is shown in FIG. 8. Referring to FIG. 8, a floor plate 15*a* and pivoting mechanism 17*a* of the alternative embodiment are shown, along with base plate 12 and a portion of stanchion 11. Floor plate 15*a* and mechanism 17*a* are equivalent to correspondingly like referenced elements 15 and 17, but now incorporating a gas feed system. In this alternative embodiment, gas is forced from a pressurized gas source to the opening 28 of each quartz tube location at base plate 12 through passages provided for such purpose.

Within the thickness of floor plate 15*a*, a hollow passage is provided extending from the outer rim to its center. This passage angles upward completely through the center of floor plate 15*a*, wherein the opening of the passage is into a hollow interior of stand 25. Although the passage can be formed simply by drilling, boring and/or cutting into the material of the floor plate 15*a*, it is preferred to lay in tubing 35 during the construction of floor plate 15*a*. Also, during the construction of ring 24, an opening 36 is formed completely through ring 24.

The interior of the stanchion 11 forms a cavity 37 for receiving the gas fed through the passage formed by tubing 35, stand 25 and opening 36. The size of this cavity is arbitrary and the size is not critical to the practice of the invention, as long as the cavity maintains a sufficiently pressure tight integrity. Thus, an upper seal and a lower seal are needed to form a pressure tight cavity 37. The upper seal is provided by a closure of the stanchion 11 by the top plate 13 or by having a wall 38 formed in the stanchion 11 proximate to mechanism 17*a*. One such wall 38 can be formed by inserting a plug into the interior of the stanchion during construction. The lower seal is formed by having a tight friction fit of circular ring 24 against stanchion 11.

Openings 39 are formed along various predetermined positions of stanchion 11 below the base plate 12 in order to reach the cavity 37. Tubing 34 are then used to connect each stanchion opening 39 to its corresponding opening 28 located at base plate 12. Tubing 34 reside just below the bottom surface of plate 12, wherein one of each tubing 34 is disposed into its corresponding opening 28 directly or through a flange or a fitting. A regulator 40, such as a valve and/or a flow meter, can be coupled to tubing 34 in order to regulate the amount of gas flow to its corresponding opening 28. Thus, gas being forced into the opening of the passage at the outer rim of the floor plate 15*a* ultimately reaches the openings disposed on the base plate 12 through the passages described above.

A variety of gases, including air, can be readily forced through the passages for a variety of purposes. In the present application nitrogen gas is used to purge the quartz tubes 31. Furthermore, by the use of regulators 40, nitrogen can be directed at desired times only to those positions on the device 10 having quartz tubes 31 residing thereon. It is appreciated that although a particular gas passage system is described, other schemes for introducing forced gases to the interior of the quartz tubes can be readily adapted without departing from the spirit and scope of the present invention. However it is to be noted that this gas distribution scheme permits the pivoting mechanism 17*a* to function properly without interference from the gas distribution system. That is, by the placement of the cavity 37 within stanchion 11 adjacent to the pivoting mechanism 17*a*, the lower passage through tubing 35 remains stationary while the upper passage through tubing 34 is allowed to rotate.

Referring to FIG. 9, another alternative embodiment of the present invention is shown. In this embodiment, the earlier described stanchion 11 is actually formed by two polypropylene tubes of differing diameters. Lower portion 43 of the stanchion is formed by the first tube while the upper portion 44 of the stanchion is formed by the second tube. The smaller diameter tube is of such dimension that it is designed to fit within the larger tube, the larger tube functioning as a sleeve over the smaller tube. By utilizing this scheme, one of the tubes or both of the portions can be made to slide in relation to each other, thereby providing for a telescoping stanchion. For example, if the outer tube, functioning as a sleeve, is used as the upper portion 44, as is shown in FIG. 9, then top plate 13 will move vertically allowing for variations in height to accommodate quartz tubes of various length. In FIG. 9, locking pins 47 are inserted when appropriate holes 48 on tubes 43 and 44 are aligned.

Additionally, as is shown in FIG. 9, handles 45 can be readily attached to stanchion 11 to permit the operator to rotate device 10 as earlier described. In this particular example, horizontal handles 45 are welded to stanchion 11 at predetermined locations and extend horizontally outward, but without interfering with the placement of the quartz tubes.

It is to be appreciated that any or all of these various features can be used with the practice of the present invention, as well as the inclusion of other functional details. Furthermore, additional holes, slots, etc., can be cut or formed in the bottom plate 12 and/or top plate 13 to accommodate tools, paddles, etc., which are normally used in conjunction with the quartz tubes 31.

Thus, a carousel device for storing quartz tubes is described. The term "carousel" is used because the device of the present invention locates a number of elements on a substantially flat disk and these elements ca be readily rotated. Upright storage of quartz tubes is provided in which critical floor space is saved. As an example, the storage of six 13 inch quartz tubes earlier described can be stored in a six-tube carousel of the present invention. Such a carousel will require 49 in. × 49 in. of floor space, and allow 360 rotation for easy access of the tubes. Earlier described optional features can be readily added or adapted to the base carousel. The actual size of the carousel will depend on the size, shape and number of quartz tubes stored.

Furthermore, it is to be noted that a number of variations to the present invention can be readily designed without departing from the spirit and scope of the present invention. For example, the carousel can be designed without the pivoting mechanism as shown and, instead, a different rotating mechanism for rotating the base plate could be readily implemented. As another example, the carousel can be designed to function without the floor plate so that the casters can be made to roll on the floor. This design allows the carousel to be easily moved to another location. Locking casters could be used to lock the carousel into stationary position. Because the casters can be used to rotate the carousel, the pivoting mechanism need not be included. However, in actual practice it would be a safety concern to move the carousel while tubes are resident thereon.

Finally, it is to be noted that although the carousel of the present invention is designed for use with quartz tubes, other cylindrical containers can be stored in a customized carousel. The carousel need not be limited to the storage of quartz tubes only.

I claim:

1. An apparatus for storing elongated containers in a vertical position comprising:

a base plate for having said elongated containers residing thereon;

a top plate having openings disposed therein for supporting an opposite end of said elongated container in order to maintain said container in said vertical position;

at least one vertical support member, having one end coupled to said base plate and its other end coupled to said top plate, for supporting said top plate in relation to said base plate;

means coupled to rotate said base and top plates, wherein said elongated containers stored on said apparatus are rotated to a desired position;

said base plate having openings disposed at locations where said containers are located in order to provide laminar air flow to the interior of said containers, if said containers are hollow.

2. The apparatus of claim 1 further including a floor plate wherein said means to rotate said base and top plates are located on said floor plate.

3. The apparatus of claim 1 wherein said openings disposed on said base plate at locations where said containers are located are for providing forced gas flow to the interior of said containers, if said containers are hollow.

4. An apparatus for storing quartz tubes in a vertical position, said quartz tubes being utilized in the fabrication of semiconductor devices, comprising:

a floor plate residing on a stationary surface;

pivoting means coupled to said floor plate;

a base plate for having said quartz tubes residing thereon, said base plate having openings disposed at locations where said quartz tubes are located in order to provide laminar air flow to the interior of said tubes;

a top plate having openings disposed therein for supporting an opposite end of said quartz tubes in order to maintain said quartz tubes in said vertical position;

a vertical support member having one end coupled to said base plate and said pivoting means and its other end coupled to said top plate for supporting said top plate, wherein said pivoting means causes said two plates to rotate to allow said quartz tubes to also rotate.

5. The apparatus of claim 4 wherein said openings disposed on said base plate at locations where said quartz tubes are located are for providing forced gas flow to the interior of said tubes.

6. The apparatus of claim 4 wherein retaining means are coupled to said top plate for preventing said opposite end of said tubes from toppling over.

7. The apparatus of claim 4 wherein said vertical support member is actually comprised of two hollow cylinders of different diameter, such that one fits over the other to function as a sleeve and provides for an adjustment in the height of said vertical support member in order to adjust the height of said top plate in relation to said base plate.

8. The apparatus of claim 4 wherein handles are coupled to said vertical member for rotating said tubes.

9. A carousel for storing quartz tubes in a vertical position, said quartz tubes being utilized in the fabrication of semiconductor devices, comprising:

a substantially flat and circular floor plate residing on a stationary surface;

pivoting means coupled to said floor plate at its center;

a substantially flat and circular base plate for having said quartz tubes residing thereon, said base plate having a central opening and a plurality of air flow openings, such that at least one of said air flow openings being disposed at each location where said quartz tubes are located in order to provide laminar air flow to the interior of said quartz tubes;

a substantially flat and circular top plate having openings disposed therein for supporting an opposite end of said quartz tubes in order to maintain said quartz tubes in said vertical position;

a cylindrical stanchion, having one end inserted through said central opening of said base plate and coupled to said pivoting means and its other end coupled to said top plate for supporting said top plate in a parallel position to said base plate;

a plurality of first supporting members coupled to said stanchion and to said base plate for supporting said stanchion in a normal position to said base plate;

a plurality of second supporting members coupled to said stanchion and to said top plate for supporting said top plate in a parallel position to said base plate;

a plurality of casters coupled to a bottom surface of said base plate and residing on said floor plate, said casters for providing rolling friction during rotation of said stanchion;

wherein rotating said stanchion about said pivoting means rotates said base and to plates, such that said quartz tubes are rotated in a circle to a desired position.

10. The carousel of claim 9 wherein said stanchion is substantially hollow.

11. The carousel of claim 10 wherein said pivoting means is comprised of a stationary cylinder residing on said floor plate such that the interior of said stanchion friction fits onto said cylinder and rotates about said cylinder.

12. The carousel of claim 11 wherein openings in said top plate are cut-outs along the rim of said top plate and being located directly above said openings in said base plate, such that a given quartz tube has its hollow interior residing over one of said openings in said base plate and its other end residing within a corresponding cut-out in said top plate.

13. The carousel of claim 12 further including retaining means coupled to said to plate for preventing each of said opposite ends of said tubes from toppling over.

14. The carousel of claim 13 wherein said air flow openings in said base plate are for providing forced gas flow through said tubes.

15. The carousel of claim 14 further including gas tubing for coupling each of said air flow openings in said base plate to the interior of said stanchion and wherein said forced gas flow is provided by a gas passage through said base plate, pivoting means and said tubing, such that each quartz tube can be gas purged.

* * * * *

UNITED STATES PATENT AND TRADEMARK OFFICE

CERTIFICATE OF CORRECTION

PATENT NO. : 5,074,421

DATED : December 24, 1991

INVENTOR(S) : David W. Coulter

It is certified that error appears in the above-identified patent and that said Letters Patent is hereby corrected as shown below:

Column 1, line 41, the --,-- should be located after "would" and not before.

Column 3, line 13, after "stanchion" insert numeral --11--.

Column 3, line 16, after "stanchion" insert numeral --11--.

Column 8, line 22, "ca" should be --can--.

Column 8, line 43, before "stationary" insert --a--.

Column 10, line 46, "to" before "plate" should be --top--.

Signed and Sealed this

Seventh Day of September, 1993

Bruce Lehman

*Attest:*

BRUCE LEHMAN

*Attesting Officer*

*Commissioner of Patents and Trademarks*